US005511942A

United States Patent [19]

Meier

[11] Patent Number: 5,511,942

[45] Date of Patent: Apr. 30, 1996

[54] AXIAL MINI VENTILATOR WITH PARABOLIC GUIDE VANES

[75] Inventor: Peter Meier, Lindau, Switzerland

[73] Assignee: Micronel AG, Switzerland

[21] Appl. No.: 332,941

[22] Filed: Nov. 1, 1994

[30] Foreign Application Priority Data

Nov. 4, 1993 [CH] Switzerland ..... 3321/93

[51] Int. Cl.[6] ..... F04D 29/52

[52] U.S. Cl. ..... 415/220; 415/211.2

[58] Field of Search ..... 415/211.2, 220

[56] References Cited

U.S. PATENT DOCUMENTS

| | | | |
|---|---|---|---|
| 1,873,336 | 8/1932 | Schmidt | 415/211.2 X |
| 2,397,171 | 3/1946 | Troller et al. | 415/211.2 |
| 3,924,964 | 12/1975 | Lievens et al. | 415/220 |
| 4,603,271 | 7/1986 | Maruyama et al. . | |
| 4,678,410 | 7/1987 | Kullen | 415/220 |
| 5,184,938 | 2/1993 | Harmsen | 415/119 |
| 5,246,339 | 9/1993 | Bengtsson et al. | 415/211.2 X |

*Primary Examiner*—Edward K. Look
*Assistant Examiner*—Michael S. Lee
*Attorney, Agent, or Firm*—Webb Ziesenheim Bruening Logsdon Orkin & Hanson

[57] ABSTRACT

An axial mini ventilator having an air conduction housing with an impeller wheel on the suction-side end of a tubular flow channel. Formed on the inside of the air conduction housing are air baffles which support the stator of an electric drive motor for the impeller wheel. The tip and/or root lines of the baffles are essentially segments of a parabola. The parabolas are oriented so that their point of origin is on the pressure-side end of the flow channel, and their plane of symmetry runs at right angles to the direction of flow. As a result of this configuration of the baffles, the turbulence in the flow channel can be reduced and the efficiency can be significantly increased.

20 Claims, 1 Drawing Sheet

AXIAL MINI VENTILATOR WITH PARABOLIC GUIDE VANES

BACKGROUND OF THE INVENTION

1. Field of the Invention

This invention relates to an axial mini ventilator which has an air conduction housing with a ring-shaped flow channel, with an impeller wheel which is located on the suction-side end of the flow channel, completely inside the air conduction housing, and with several permanently installed air baffles which extend radially in the flow channel and have curved tip and root lines.

2. Description of the Prior Art

The prior art includes numerous models of ventilators or fans of this type. For example, U.S. Pat. No. 4,603,271 discloses a ventilator which, as illustrated in FIG. 7, has blade rows on both sides of the impeller wheel. The blades form baffles curved in a circular fashion which extend radially in a ring-shaped flow channel and which are used to create the most laminar axial air flow possible through the flow channel. Such ventilators are called axial ventilators, since the air flows through the flow channel essentially coaxially with respect to the axis of the rotor.

If such mini ventilators are to be used as built-in ventilators, for example ventilators which are incorporated in a medical device or in a dental treatment instrument, these mini ventilators must meet special requirements. Since these ventilators are, as a rule, powered by an electric battery, they must achieve the longest possible operating time with the highest possible efficiency from each battery. During operation, the levels of noise generated and heat produced should also be as low as possible.

The object of the invention is to create a ventilator of the type described above which comes significantly close to meeting the requirements indicated above and which can still be manufactured economically.

SUMMARY OF THE INVENTION

The invention teaches that this object can be achieved in an axial mini ventilator of the type described above if the tip and/or root lines of the baffles are each essentially segments of a parabola, whereby the point of origin of the coordinates of the parabola is at the pressure-side end of the flow channel, and the plane of symmetry of the parabola runs at right angles to the direction of the flow. As a result of the parabolic curvature of the baffles, in the axial mini ventilator according to the invention the entry angle is smaller and the exit angle is larger than with an axial mini ventilator of the prior art which has baffles which are curved in a circular fashion. It has been determined that the turbulence in the flow channel is significantly reduced in such an axial mini ventilator.

Tests have also shown that the pneumatic efficiency, which is 15% to 20% in axial mini ventilators of the prior art, can be increased to approximately 30%. The ratio of the pneumatic energy output to the electrical energy input can also be significantly increased. For example, a measurement of a pneumatic energy output of 205 mW can be achieved with electrical energy input of 869 mW. The lower turbulence and the higher efficiency result in a longer operating time and a lower noise level.

The invention thereby makes it possible to construct axial mini ventilators without additional parts, so that they are more compact and lighter weight. The axial mini ventilator according to the invention is therefore particularly well-suited for use in medical or dental equipment or for incorporation in miner's helmet.

Additional advantageous features are disclosed and explained in the following description and illustrated in the accompanying drawings. One embodiment of the invention is explained in greater detail below with reference to the accompanying drawings wherein like reference characters indicate like parts.

DETAILED DESCRIPTION OF A PRESENTLY PREFERRED EMBODIMENT OF THE INVENTION

Figure 1:
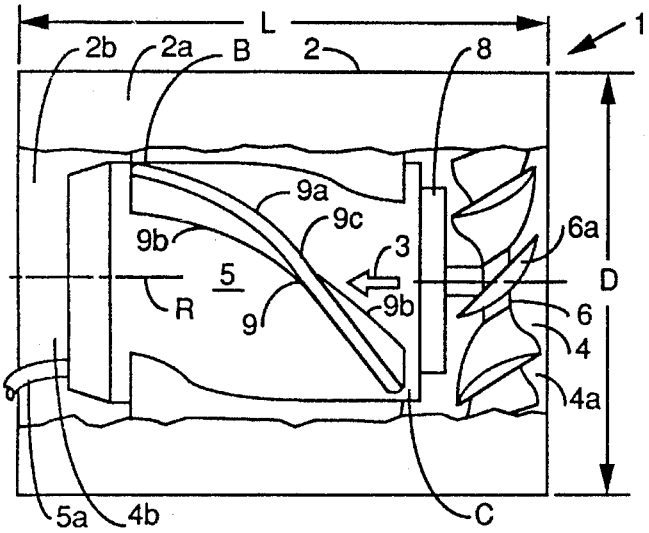
FIG. 1 is a view in partial section of an axial mini ventilator according to the invention.

FIG. 1 shows an axial mini ventilator 1 with a tubular air conduction housing 2 which has a ring-shaped flow channel 4 with a suction-side end 4*a* and a pressure-side end 4*b*. Oriented coaxially with a circular and cylindrical inside 2*b* of the air conduction housing 22 there is an electric drive motor 5 which is supported by four baffles 9. Baffles 9 are each formed on a tip line 9*a* and a root line 9*b* on the inside 2*b* and a circular and cylindrical outside 8*a* of stator 8 of motor 5. The length L of the housing 2 is 4.5 cm. for example. With regard to optimal smoothing of the air flow in the flow channel 4, a ratio of the length L to the diameter D of the housing 2 of 1:0.8 has proven optimal. The ratio indicated above, however, must be in a range from 1:0.5 to 1:2.

A rotor located in the stator 8 of motor 5 supports an impeller wheel 6 with several blades 6*a* formed on a hub. As shown in the accompanying drawings, the impeller wheel is located completely within air conduction housing 2. The blades 6*a* are preferably not twisted, and they all have the same angle of incidence over the entire chord of the impeller blade. As the impeller wheel 6 turns, air is sucked in at the suction-side end 4*a* in the direction indicated by the arrow 3 and is discharged from the flow channel 4 at the pressure-side end 4*b*. The air thus runs through air conduction housing 2 coaxially with the rotor axis R. The curve of the four air baffles 9 is important for reduced turbulence and a laminar flow.

Figure 2:
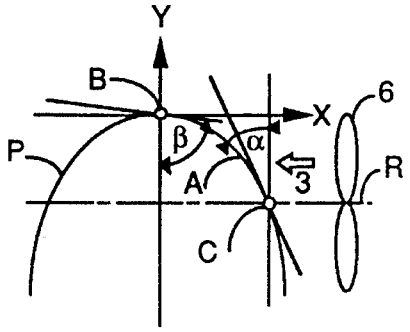
FIG. 2 is a schematic illustration of the curve of a baffle.
Figure 3:
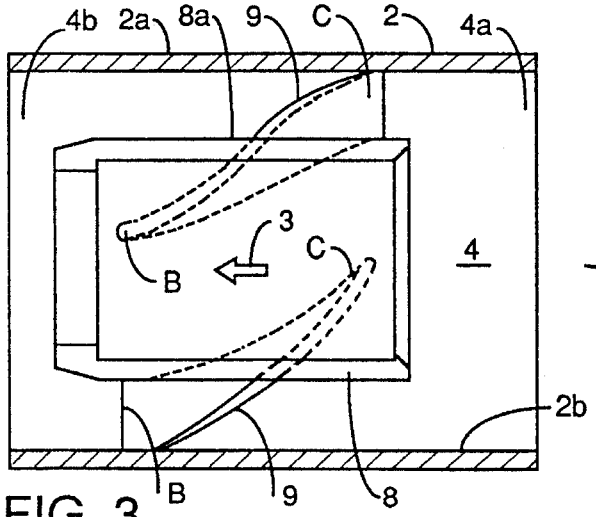
FIG. 3 is a longitudinal section through an air conduction housing.
Figure 4:
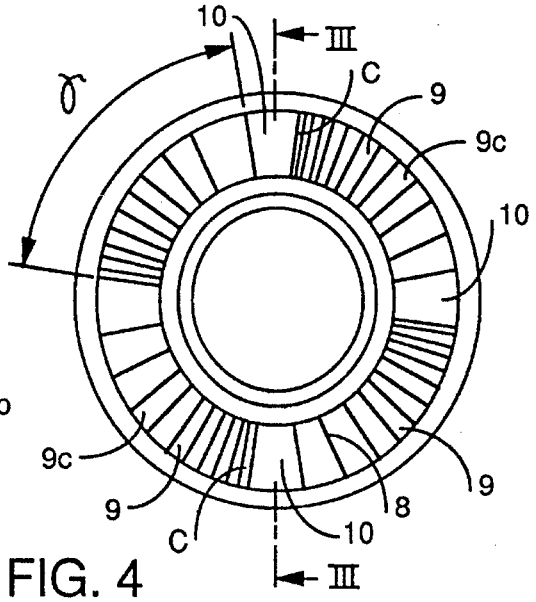
FIG. 4 is an end view of the rear of the air conduction housing illustrated in FIG. 3.

The four baffles 9 are oriented rotationally symmetrically in the flow channel 4 and extend radially between cylindrical surfaces 2*b* and 8*a*. The tip line 9*a* and the root line 9*b* of each baffle 9 each runs in the shape of a parabola between an entry end C and an exit end B, as shown in greater detail in the schematic illustration in FIG. 2. In this figure, the line P forms a parabola with the plane of symmetry Y which runs perpendicular to the direction of flow indicated by arrow 3. The segment A in FIG. 2 shows the curve of the tip line 9*a* on the surface 2*b* or the curve of the root line 9*b* on the surface 8*a*. The exit end B of the root line 9*b* or of the tip line 9*a* is located approximately at the point of origin of the coordinates of parabola P. The entry angle e of the flow surface 9c is defined here as the angle between the tangent to the flow surface 9c and the axis of symmetry Y. This entry angle e is between about 10° and about 60° and is preferably between 20° and 45°. The exit angle β is defined here as the angle between the line of symmetry Y and the tangent to the baffle surface. This angle β is essentially 90°. The tip line 9a and the root line 9b thus form a segment of a branch of the parabola P, whereby the endpoint B is in the vicinity of the point of origin of the coordinates of the parabola P. This point of origin is approximately at the output end of B and the latter in turn is on the pressure-side end 4b of flow channel 4. As shown in the drawings, the axial length of baffles 9 is greater than the length of stator 8 in the circumferential direction. The number of baffles 9 can vary, but the optimal number is three to five baffles 9. These baffles, as shown in FIG. 4, are oriented so that they are rotationally symmetrical to one another, and in this view extend overt an angle γ of approximately 70°. Between two neighboring baffles 9, there is thus a window 10 which extends over an angle of 20°. But it is also contemplated that there could be an embodiment with unequal baffles 9, and/or with baffles 9 arranged other than symmetrically.

Figure 5:
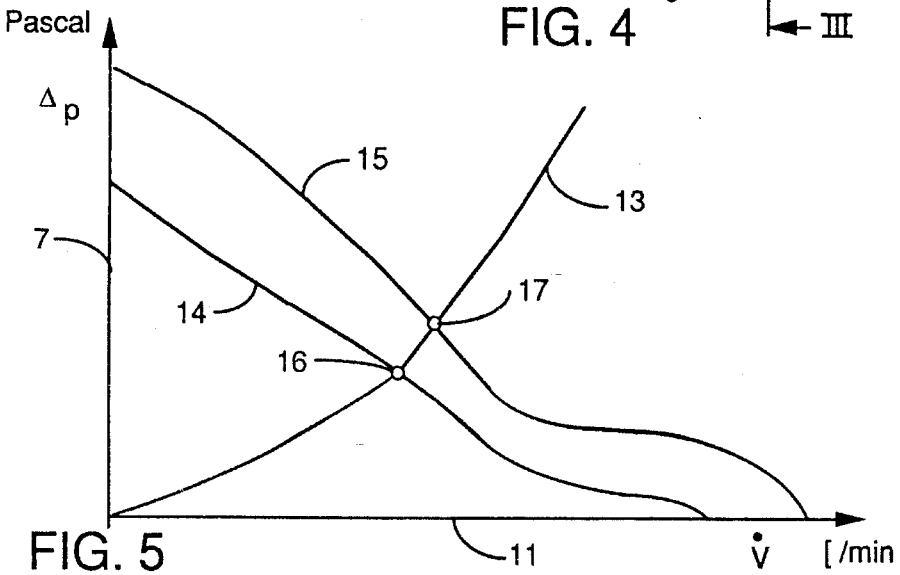
FIG. 5 is a diagram of the air flow through a mini ventilator according to the invention.

FIG. 5 shows an air flow diagram with measurements of an axial mini ventilator as set forth in the invention. The X-axis 11 indicates the volume flow in liters per minute, and the Y-axis 7 indicates the pressure difference in pascals. The curve 13 is the reference curve obtained with a measurement diaphragm as specified by DIN 1952. The curve 14 represents the curve of the performance of a comparable axial mini ventilator with straight air baffles, while the performance curve 15 indicates the values of the axial mini ventilator according to the invention. As shown in FIG. 5, there is a significant distance between the intersections 16 and 17 which corresponds to the higher efficiency of the ventilator of the invention. The measurements were taken in ambient air at a temperature of 26° C. and at an air pressure of 965 hPa.

Having described a presently preferred embodiment of the invention, it may be otherwise embodied within the scope of the appended claims.

I claim:

1. An axial mini ventilator comprising an air conduction housing with a ring-shaped flow channel having a suction-side end and a pressure-side end, an impeller wheel located on the suction-side end of the flow channel completely within the air conduction housing, a plurality of baffles extending radially in the flow channel in the air conduction housing and having curved tip and root lines, the tip and root lines of the baffles being both essentially segments of a parabola such that the baffles are radially twisted, whereby the point of origin of the coordinates of the parabola is located on the pressure-side end of the flow channel and the plane of symmetry of the parabola extends transversely to the direction of flow in the flow channel of the air conduction housing.

2. An axial mini ventilator as claimed in claim 1, wherein on the pressure-side end of the baffles, the angle β between the tangent to the baffle surface and the axis of symmetry of the parabola is 80° to 90°.

3. An axial mini ventilator as claimed in claim 1, wherein the air conduction housing has a tubular shape.

4. An axial mini ventilator as claimed in claim 1, wherein the length of the air conduction housing is greater than its outside diameter.

5. An axial mini ventilator as claimed in claim 4, wherein on the endpoints of the baffles close to the vanes, the angle α between the tangent to the baffle surface and the plane of symmetry of the parabola is between about 10° and about 60°.

6. An axial mini ventilator as claimed in claim 4, wherein on the pressure-side end of the baffles, the angle β between the tangent to the baffle surface and the axis of symmetry of the parabola is 80° to 90°.

7. An axial mini ventilator as claimed in claim 1, wherein the ratio of the diameter to the length of the housing is greater than 1:0.5 and less than 1:2.

8. An axial mini ventilator as claimed in claim 7, wherein on the pressure-side end of the baffles, the angle β between the tangent to the baffle surface and the axis of symmetry of the parabola is 80° to 90°.

9. An axial mini ventilator as claimed in claim 1, wherein on the endpoints of the baffles close to the vanes, the angle α between the tangent to the baffle surface and the plane of symmetry of the parabola is between about 10° and about 60°.

10. An axial mini ventilator as claimed in claim 9, wherein said angle α between the tangent to the baffle surface and the plane of symmetry of the parabola is between 20° and 45°.

11. An axial mini ventilator as claimed in claim 9, wherein the angle α is approximately 30°.

12. An axial mini ventilator as claimed in claim 1, wherein the baffles support a drive motor which is oriented coaxially within the air conduction housing.

13. An axial mini ventilator as claimed in claim 12, wherein the length of the air conduction housing is greater than its outside diameter.

14. An axial mini ventilator as claimed in claim 13, wherein on the endpoints of the baffles close to the vanes, the angle α between the tangent to the baffle surface and the plane of symmetry of the parabola is between about 10° and about 60°.

15. An axial mini ventilator as claimed in claim 13, wherein on the pressure-side end of the baffles, the angle β between the tangent to the baffle surface and the axis of symmetry of the parabola is 80° to 90°.

16. An axial mini ventilator as claimed in claim 12, wherein the ratio of the diameter to the length of the housing is greater than 1:0.5 and less than 1:2.

17. An axial mini ventilator as claimed in claim 16, wherein on the pressure-side end of the baffles, the angle β between the tangent to the baffle surface and the axis of symmetry of the parabola is 80° to 90°.

18. An axial mini ventilator as claimed in claim 12, wherein on the endpoints of the baffles close to the vanes, the angle α between the tangent to the baffle surface and the plane of symmetry of the parabola is between about 10° and about 60°.

19. An axial mini ventilator as claimed in claim 12, wherein on the pressure-side end of the baffles, the angle β between the tangent to the baffle surface and the axis of symmetry of the parabola is 80° to 90°.

20. An axial mini ventilator as claimed in claim 12, wherein the air conduction housing has a tubular shape.

* * * * *

UNITED STATES PATENT AND TRADEMARK OFFICE

CERTIFICATE OF CORRECTION

PATENT NO. : 5,511,942

DATED : April 30, 1996

INVENTOR(S) : Peter Meier

It is certified that error appears in the above-indentified patent and that said Letters Patent is hereby corrected as shown below:

Column 1 Line 67 after "lighter" insert --in--.

Column 2 Line 3 before "miner's" insert --a--.

Column 2 Line 67 "angle e" should read --angle $\alpha$--.

Column 3 Line 3 "angle e" should read --angle $\alpha$--.

Column 3 Line 18 "overt" should read --over--.

Signed and Sealed this

Sixteenth Day of July, 1996

Bruce Lehman

*Attest:*

BRUCE LEHMAN

*Attesting Officer*

*Commissioner of Patents and Trademarks*